US010343419B2

(12) United States Patent
Kubo

(10) Patent No.: US 10,343,419 B2
(45) Date of Patent: Jul. 9, 2019

(54) CONTROL APPARATUS, CONTROL METHOD, FORMING APPARATUS, AND STORAGE MEDIA

(71) Applicant: CANON KABUSHIKI KAISHA, Tokyo (JP)

(72) Inventor: Hideki Kubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/376,978

(22) Filed: Dec. 13, 2016

(65) Prior Publication Data

US 2017/0210145 A1 Jul. 27, 2017

(30) Foreign Application Priority Data

Jan. 21, 2016 (JP) ..... 2016-010010

(51) Int. Cl.
*B41J 11/00* (2006.01)
*B41J 2/01* (2006.01)
*B41M 7/00* (2006.01)

(52) U.S. Cl.
CPC ..... *B41J 11/0015* (2013.01); *B41J 2/01* (2013.01); *B41M 7/00* (2013.01)

(58) Field of Classification Search
CPC ..... B41J 11/0015
USPC ..... 399/341
See application file for complete search history.

(56) References Cited

U.S. PATENT DOCUMENTS 5,321,486 A 6/1994 Nanbu et al.
7,417,768 B1 * 8/2008 Donovan ..... G06K 15/102 358/2.1
8,177,349 B2 5/2012 Fukui ..... 347/102
8,415,001 B2 * 4/2013 Yamashita ..... B44F 1/045 428/13
8,417,135 B2 * 4/2013 Mestha ..... G03G 15/50 399/15
2009/0220261 A1 * 9/2009 Kubo ..... G03G 15/5041 399/49
2011/0157272 A1 * 6/2011 Ikehata ..... B41J 2/2114 347/16
2013/0061767 A1 * 3/2013 Casals ..... B41M 1/14 101/202
2013/0162715 A1 * 6/2013 Tombs ..... B41J 2/2132 347/19
2014/0132968 A1 * 5/2014 Bitoh ..... A45D 29/00 358/1.6
2014/0220319 A1 * 8/2014 Koike ..... B41M 5/0017 428/207

(Continued)

FOREIGN PATENT DOCUMENTS

JP 2000-318140 11/2000
JP 3227187 B2 11/2001
JP 2009-208348 9/2009

*Primary Examiner* — Anthony H Nguyen
(74) *Attorney, Agent, or Firm* — Venable LLP

(57) ABSTRACT

A control apparatus supplies a pattern to a forming apparatus for forming a gloss layer to provide gloss to a surface of a roughness shape. The control apparatus includes a derivation unit configured to derive the pattern based on height information representing the height of the roughness shape and gloss information representing the gloss level of the gloss, wherein the derivation unit determines an area ratio at which ink dots are ejected per unit area by the forming apparatus.

17 Claims, 11 Drawing Sheets

(56) References Cited

U.S. PATENT DOCUMENTS

2014/0340456 A1* 11/2014 Waschnig ..... B41M 7/0081
347/102
2016/0009107 A1* 1/2016 Nakai ..... B41M 5/0011
347/102

* cited by examiner mTH MAIN SCANNING m+1TH MAIN SCANNING m+2TH MAIN SCANNING

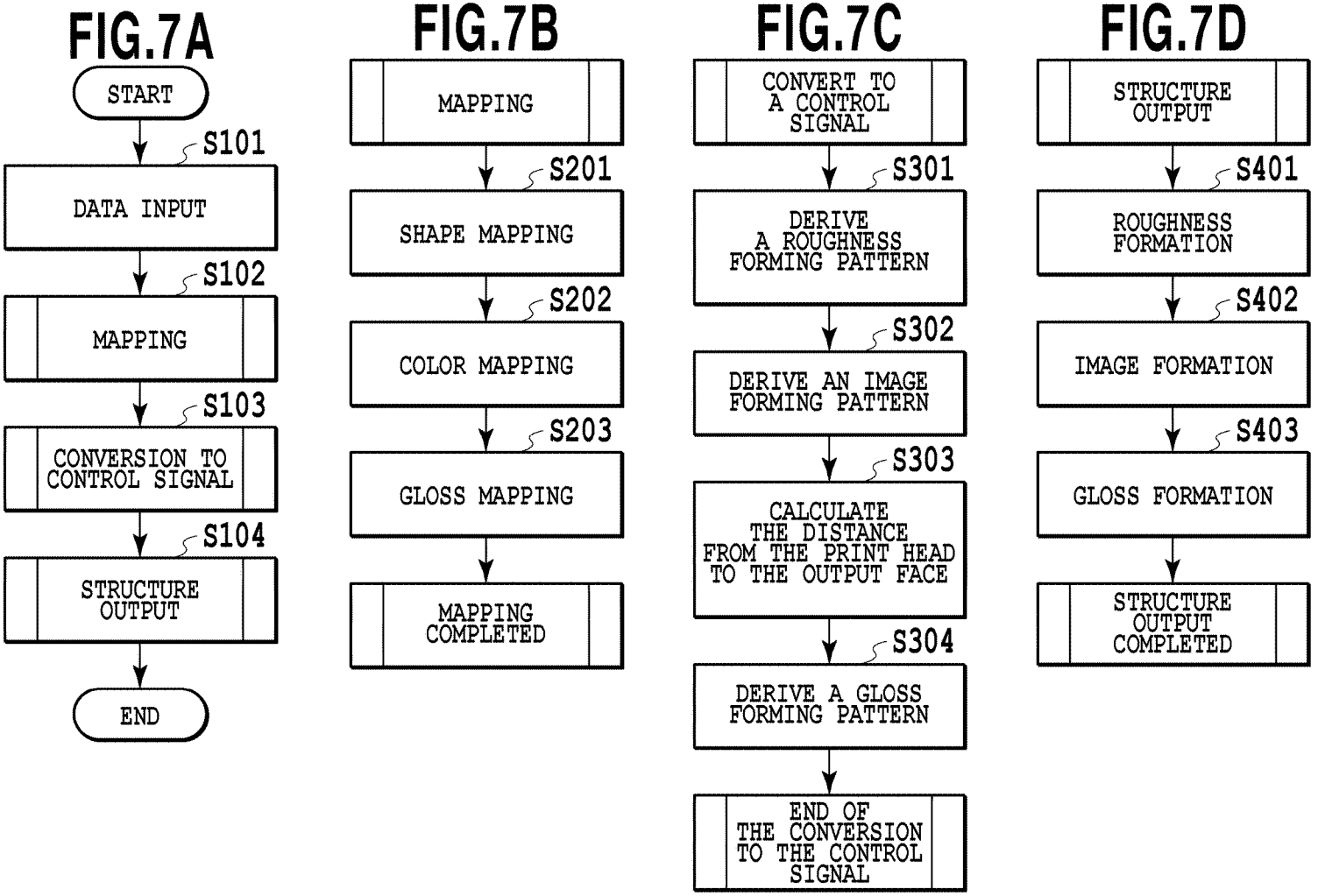
FIG.7A
START
S101
DATA INPUT
S102
MAPPING
S103
CONVERSION TO CONTROL SIGNAL
S104
STRUCTURE OUTPUT
END
FIG.7B
MAPPING
S201
SHAPE MAPPING
S202
COLOR MAPPING
S203
GLOSS MAPPING
MAPPING COMPLETED
FIG.7C
CONVERT TO A CONTROL SIGNAL
S301
DERIVE A ROUGHNESS FORMING PATTERN
S302
DERIVE AN IMAGE FORMING PATTERN
S303
CALCULATE THE DISTANCE FROM THE PRINT HEAD TO THE OUTPUT FACE
S304
DERIVE A GLOSS FORMING PATTERN
END OF THE CONVERSION TO THE CONTROL SIGNAL
FIG.7D
STRUCTURE OUTPUT
S401
ROUGHNESS FORMATION
S402
IMAGE FORMATION
S403
GLOSS FORMATION
STRUCTURE OUTPUT COMPLETED

FIG.9A

| IN | OUT |
|---|---|
| SHAPE SIGNAL H | CLEAR INK AMOUNT $CL_H$[%] |
| 0 | 0 |
| 16 | 100 |
| 32 | 200 |
| ... | ... |
| 240 | 1500 |
| 255 | 1600 |

FIG.9B

| IN | | | OUT | | | |
|---|---|---|---|---|---|---|
| L* | a* | b* | C | M | Y | K |
| 40 | 0 | 0 | 22 | 23 | 10 | 58 |
| 60 | 0 | 16 | 24 | 31 | 13 | 29 |
| 80 | 0 | 0 | 17 | 16 | 10 | 10 |
| ... | ... | ... | ... | ... | ... | ... |

FIG.9C

| IN | | OUT | |
|---|---|---|---|
| HEAD DISTANCE D'[mm] | GLOSS SIGNAL G | GLOSS FORMING PATTERN $CL_G'$ | |
| | | AREA RATIO A[%] | SUPERPOSITION NUMBER n |
| 0.5 | 0 | 25 | 5 |
| | 16 | 25 | 4 |
| | ... | ... | ... |
| | 255 | 80 | 1 |
| 1.0 | 0 | 20 | 7 |
| | 16 | 20 | 6 |
| | ... | ... | ... |
| | 255 | 90 | 1 |
| 1.5 | 0 | 15 | 10 |
| | 16 | 18 | 8 |
| | ... | ... | ... |
| | 255 | 100 | 1 |
| ... | | | |

CONTROL APPARATUS, CONTROL METHOD, FORMING APPARATUS, AND STORAGE MEDIA

BACKGROUND OF THE INVENTION

Field of the Invention

The present invention relates to a print control technique to form a gloss layer on a surface of a roughness shape to output a glossy structure.

Description of the Related Art

A printing apparatus has been known to form a gloss layer on a surface of a roughness shape to output a glossy structure. The roughness shapes exemplarily include an example of an embossed paper subjected to a press working. A printing apparatus has been known by which ultraviolet curable clear ink for example is ejected onto such an embossed paper to form a gloss layer to thereby obtain a structure having a desired gloss appearance.

A gloss appearance includes a glossy texture providing a glossy and shiny texture and a mat (or matte) texture providing a moist texture having a weak gloss level for example. Japanese Patent Laid-Open No. 2009-208348 discloses an image forming apparatus to control the ejection volume of the clear ink and the ultraviolet irradiation timing for example to thereby output glossy printed matters having different gloss appearances such as a glossy texture and a mat texture for example.

In addition to the embossed paper, an arbitrary roughness shape can be formed by a 3D printer for example. Japanese Patent Laid-Open No. 2000-318140 discloses an inkjet printer to control the ink superposition number to thereby form a roughness shape on a print paper to output a printed matter providing a three-dimensional texture. It is desired to further form a gloss layer on a surface of the formed roughness shape to provide a structure having a desired gloss.

SUMMARY OF THE INVENTION

The control apparatus of the present invention is a control apparatus for supplying, to a forming apparatus for forming a gloss layer providing a gloss to a surface of a roughness shape, a pattern for forming the gloss layer, comprising: a derivation unit configured to derive the pattern based on height information representing the height of the roughness shape and gloss information representing the gloss level of the gloss, wherein the derivation unit determines an area ratio at which ink dots are ejected per a unit area by the forming apparatus.

Further features of the present invention will become apparent from the following description of exemplary embodiments (with reference to the attached drawings).

BRIEF DESCRIPTION OF THE DRAWINGS

FIG. 7A is a flowchart illustrating a procedure to output a structure in the embodiment;

FIG. 7B is a flowchart illustrating a mapping processing in the embodiment;

FIG. 7C is a flowchart illustrating a procedure of a conversion processing to obtain a control signal in the embodiment;

FIG. 7D is a flowchart illustrating a procedure to output a structure in the embodiment;

FIG. 9A to FIG. 9C are lookup tables referred to in the signal conversion processing in the embodiment;

DESCRIPTION OF THE EMBODIMENTS

Generally, an inkjet print-type image forming apparatus has an appropriate distance from a print head to an output face. Within the range of the appropriate distance, a high landing accuracy is obtained at which ink dots ejected through the print head land at desired positions. On the other hand, if the range of the appropriate distance is exceeded, the landing accuracy of ink dots decreases. Thus, a phenomenon called mist is caused for example in which ink dots are stirred up by air current and fail to land at the output face. This may consequently cause a case where a high-definition image cannot be obtained.

In a case where the inkjet printing method is used to form a gloss layer on a surface of a roughness shape, a distance from the print head to the output face is different because roughness shapes generally have different heights. Thus, it is difficult to maintain the appropriate distance from the print head to the output face.

The following section will describe an embodiment to carry out the present invention with reference to the drawings. Components described in this embodiment are merely illustrative and do not intend to limit the scope of the present invention.

Embodiment (Hardware Configuration of the Gloss Control Apparatus)

Figure 1:
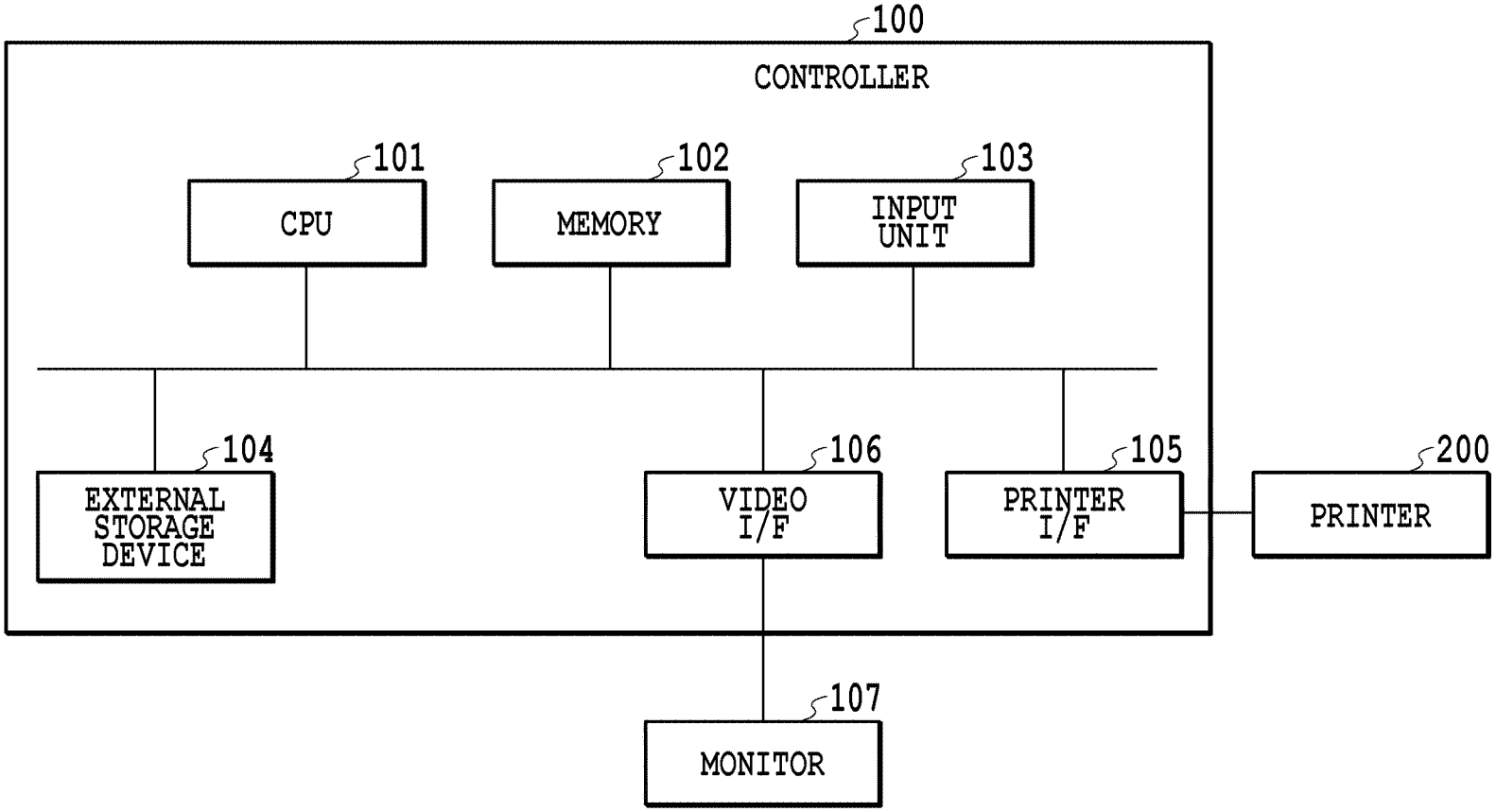
FIG. 1 is a hardware configuration diagram of a structure formation system in an embodiment.

FIG. 1 is a block diagram illustrating the hardware configuration of a structure formation system in this embodiment. In the structure formation system of FIG. 1, a controller 100 is a computer for example and includes a CPU 101, a memory 102, an input unit 103 composed of a keyboard and a mouse for example, and an external storage device 104 such as a hard disk drive. Furthermore, the controller 100 includes a printer I/F 105 functioning as a communication interface with a printer 200 functioning as a forming apparatus (hereinafter the term "interface" will be referred to as "I/F") and a video I/F 106 functioning as a communication I/F with a monitor 107.

The CPU 101 executes various processings based on programs stored in the memory 102. In particular, the CPU 101 executes a mapping processing and a control signal conversion processing of the embodiment. These programs are stored in the external storage device 104 or are supplied from a not-shown external apparatus. The controller 100 outputs various pieces of information to the monitor 107 via the video I/F 106 and receives various pieces of information through the input unit 103. The controller 100 is connected to the printer 200 via the printer I/F 105 to send various forming pattern signals converted by the control signal conversion processing to the printer 200 for printing. The controller 100 receives various pieces of information from the printer 200.

(Schematic Configuration of the Printer)

Figure 2:
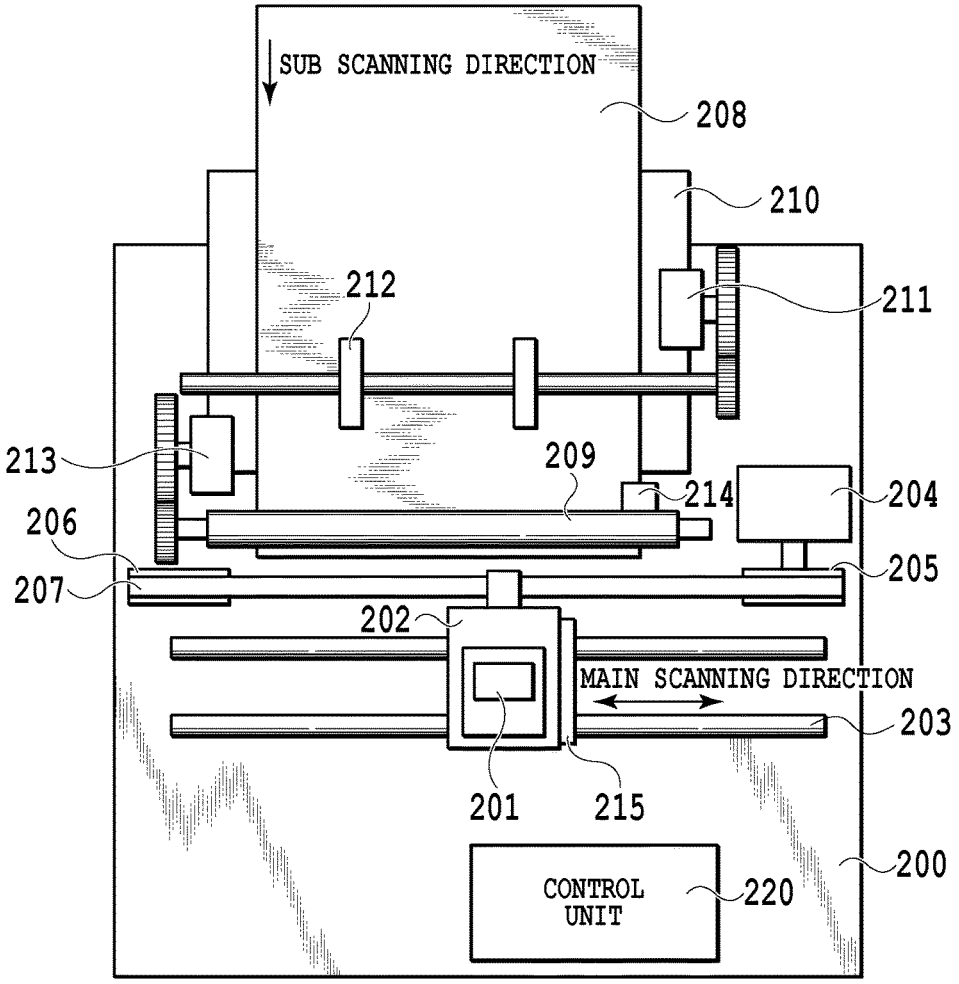
FIG. 2 is a schematic view illustrating the printer configuration in an embodiment.

FIG. 2 is a schematic view illustrating the configuration of the printer 200 in this embodiment. In this embodiment, the printer 200 is realized by an inkjet printer to use a plurality of types of inks to print a shape, an image, and a gloss. The head cartridge 201 of the printer 200 has a print head consisting of a plurality of ejection openings and a plurality of types of ink tanks to supply ink to the print head. A connector is provided to receive a signal to drive the respective ejection openings of the print head for example. A shape, an image, and a gloss formed by a plurality of types of inks will be referred to as a roughness layer, an image layer, and a gloss layer, respectively.

The ink tanks are independently provided to correspond to clear ink for forming a roughness layer, a gloss layer and an image layer as well as color inks of cyan (C), magenta (M), yellow (Y), black (K), and white (W), respectively. The head cartridge 201 is positioned in a carriage 202 in an exchangeable manner. The carriage 202 includes a connector holder to transmit a driving signal for example to the head cartridge 201 via the connector. The carriage 202 includes an ultraviolet irradiation device 215. Curable clear ink ejected from the print head is irradiated with ultraviolet light from the ultraviolet irradiation device 215 and is subsequently fixed on a print medium. The carriage 202 can be reciprocated along the guide shaft 203. Specifically, the carriage 202 is driven by a main scanning motor 204 functioning as a driving source via a driving mechanism such as a motor pulley 205, a driven pulley 206, and a timing belt 207 to control the position and travel thereof. The travel of the carriage 202 along the guide shaft 203 is referred to as a "main scanning" and the travel direction is referred to as a "main scanning direction".

A print medium 208 such as a print paper is placed on an auto sheet feeder 210 (hereinafter referred to as "ASF"). When the printer 200 performs a print operation, a paper feed motor 211 is driven to rotate a pickup roller 212 via a gear and the print media 208 are separated from the ASF 210 one by one, thereby feeding papers. Furthermore, the print medium 208 is conveyed by the rotation of a conveyance roller 209 to a print starting position opposed to the ejection opening face of the head cartridge 201 on the carriage 202. The conveyance roller 209 is driven via a gear by a line feed (LF) motor 213 functioning as a driving source. Whether or not the print medium 208 is fed is determined and the paper feed starting position (cueing position) of the print medium 208 is fixed at a timing at which the print medium 208 passes a paper end sensor 214. The head cartridge 201 provided in the carriage 202 is retained so that the ejection opening face is downwardly protruded from the carriage 202 to be parallel to the print medium 208. A control unit 220 is composed of a CPU and a storage apparatus for example. The printer 200 controls the operations of the respective parts of the printer 200 based on print data including shape information, image information, and gloss information supplied from the exterior such as the controller 100.

(Print Operation)

Next, the following section will describe the print operation in the printer 200 of FIG. 2. First, when the print medium 208 is conveyed to a predetermined print starting position, the carriage 202 travels on the print medium 208 along the guide shaft 203 during which ink is ejected through the ejection openings of the print head. The ultraviolet irradiation device 215 irradiates ultraviolet light in accordance with the travel of the print head to cure the ejected ink. As a result, the ejected ink is fixed on the print medium. Then, the travel of the carriage 202 to one end of the guide shaft 203 causes the conveyance roller 209 to convey the print medium 208 by a predetermined amount in a direction vertical to the scanning direction of the carriage 202. This conveyance of the print medium 208 is referred to as "paper feeding" or "sub scanning". This conveyance direction is referred to as "paper feeding direction" or "sub scanning direction". When the conveyance of the print medium 208 by the predetermined amount is completed, the carriage 202 is traveled again along the guide shaft 203. By repeating the scanning by the carriage 202 of the print head and the paper feeding in the manner as described above, a roughness layer is formed on the entire print medium 208. Next, after the formation of the roughness layer, the conveyance roller 209 returns the print medium 208 to the print starting position. A process similar to the process of forming the roughness layer is repeated, thereby forming an image layer on the roughness layer. Furthermore, processes similar to the process of forming a roughness layer and the process of forming an image layer are repeated, thereby forming a gloss layer on the image layer.

Figure 3:
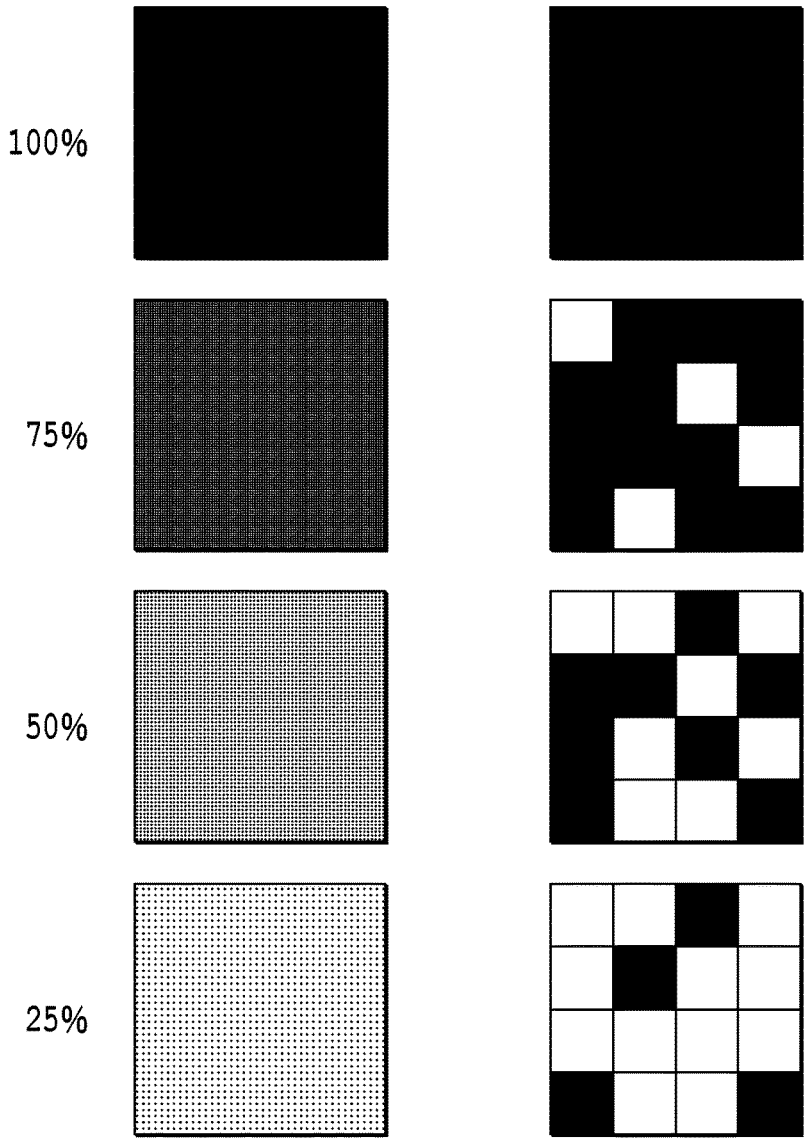
FIG. 3 is a schematic view illustrating an image gradation expression based on the area coverage modulation method.

FIG. 3 is a schematic view illustrating the image gradation expression based on the area coverage modulation method. The print head basically provides the expression based on a binary control whether or not to eject ink droplets. In this embodiment, ink is ON/OFF-controlled with respect to each pixel defined based on the output resolution of the printer 200. An ink amount is defined as 100% in the status where all pixels are ON per a unit area. In a so-called binary printer as described above, a single pixel can provide 100% or 0% expression. Thus, a collection of a plurality of pixels is used to express a half tone. In the example of FIG. 3, in the case of a 25% density half tone expression shown at the lower-left side of the drawing, ink is ejected to 4 pixels among 4×4 pixels (the total of 16 pixels) as shown in the lower-right side of the drawing to thereby provide an expression of 4/16=25% based on the area. Similar expressions also can be achieved for other gradations.

A pattern of pixels to be turned ON is determined using a cyclic screen processing or an error diffusion processing for example. However, the total number of pixels to express a half tone or a pattern of pixels to be turned ON for example is not limited to the above example. In the image gradation expression based on the area coverage modulation method, a print head for which the ink ejection volume can be modulated can be used to achieve a multivalued processing providing a higher gradation than the binary processing. The embodiment is not limited to the binary control.

In the roughness layer formation of the embodiment, the above-described ink amount concept is used to perform a height control for each position. In the roughness layer formation, in a case where a substantially uniform roughness layer is formed with a 100% ink amount, the roughness layer has a certain thickness or height depending on the volume of ejected ink. In a case where a layer formed with a 100% ink amount has a thickness of 20 μm for example, a thickness of 100 μm may be reproduced by superposing the layer five times. Specifically, the ink amount ejected to a position requiring the height of 100 μm is calculated as 500%.

Figure 4A:
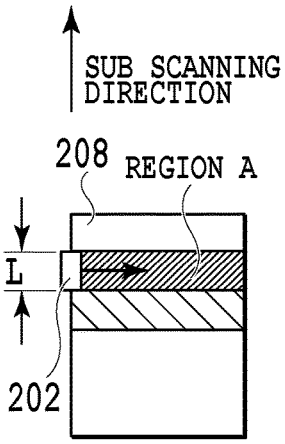
FIG. 4A to FIG. 4E illustrate the operation of a printer to form the respective layers in the embodiment.
Figure 4B:
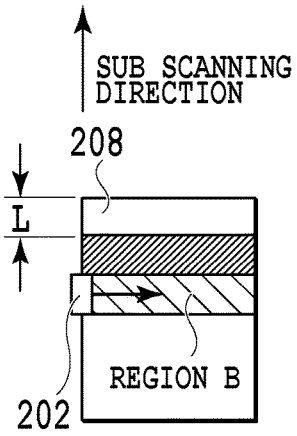

FIG. 4A to FIG. 4E illustrate an operation to form a roughness layer, an image layer, and a gloss layer by scanning the print head over the print medium 208. The main scanning by the carriage 202 is used to form a roughness layer for the width L of the print head. Whenever the printing of one line is completed, the print medium 208 is conveyed for the distance L in the sub scanning direction. For simple description, it is assumed that the printer 200 in this embodiment can eject ink of a 100% ink amount at a maximum in a single scanning operation. Thus, in a case where the printer 200 forms a layer requiring an ink amount exceeding the 100% ink amount, the printer 200 causes the print head to scan a single region a plurality of times without conveying the print medium 208. For example, in a case where the amount of ejected ink is 500% at a maximum, the print head scans the same line five times. This will be described with reference to FIG. 4A to FIG. 4E. The region A is scanned by the print head five times (FIG. 4A). Then, the print medium 208 is conveyed in the sub scanning direction by the distance L. The main scanning of the region B is repeated five times (FIG. 4B). In order to suppress a deteriorated image quality such as a cyclic unevenness caused by the driving accuracy of a print head, there may be a case where a plurality of number of scannings (so-called multi-pass print) are performed even when the amount of ejected ink is a 100% ink amount or less.

Figure 4C:
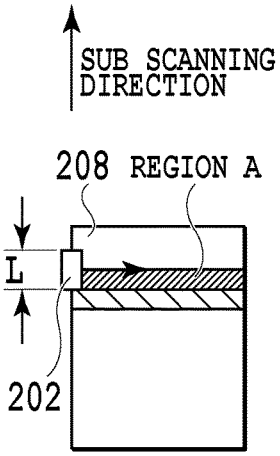
Figure 4D:
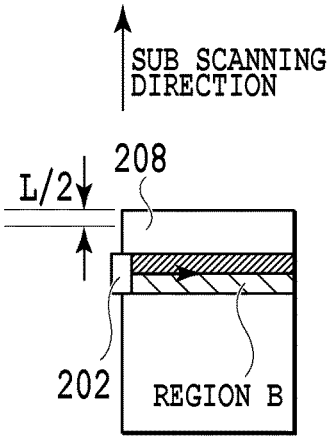
Figure 4E:
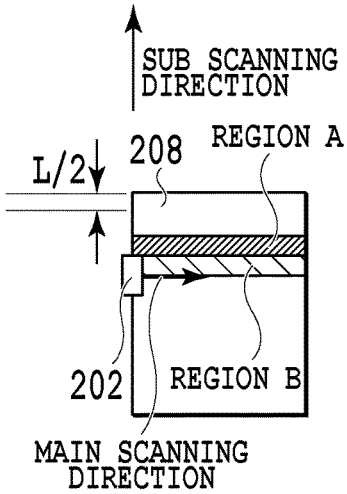

FIG. 4C to FIG. 4E illustrate an example of a 2 pass printing. In the example of FIG. 4C to FIG. 4E, the printing is performed by the width L of the print head through the main scanning by the carriage 202. Whenever the printing for one line is completed, the print medium 208 is conveyed in the sub scanning direction on the basis of a unit of the distance L/2. The region A is printed by the mth main scanning of the print head (FIG. 4C) and m+1th main scanning (FIG. 4D). The region B is printed by the m+1th main scanning of the print head (FIG. 4D) and the m+2th main scanning (FIG. 4E). The operation for the 2 pass printing has been described. The number of passes can be changed depending on the accuracy or image quality of a roughness shape required for an image to be printed. In a case where the n pass printing is performed, whenever the printing of one line is completed for example, the print medium 208 is conveyed in the sub scanning direction on the basis of a unit of the distance L/n. In this case, even in a case where the ink amount is 100% or less, a roughness layer, an image layer, or a gloss layer is formed by using a plurality of divided print patterns so that a single line on the print medium 208 can be subjected to the n main scannings by the print head.

In this embodiment, in order to prevent a situation where the above-described scanning based on the multi-pass print is confused with a scanning to eject 100% or more ink, the following description will be made based on an assumption that no multi-pass print is performed and a plurality of scannings are performed in order to provide a layered structure. This embodiment can be applied to any print medium such as paper or a plastic film so long as the print medium can be used to receive an image by the print head.

(Roughness Layer, Image Layer, and Gloss Layer)

Figure 5:
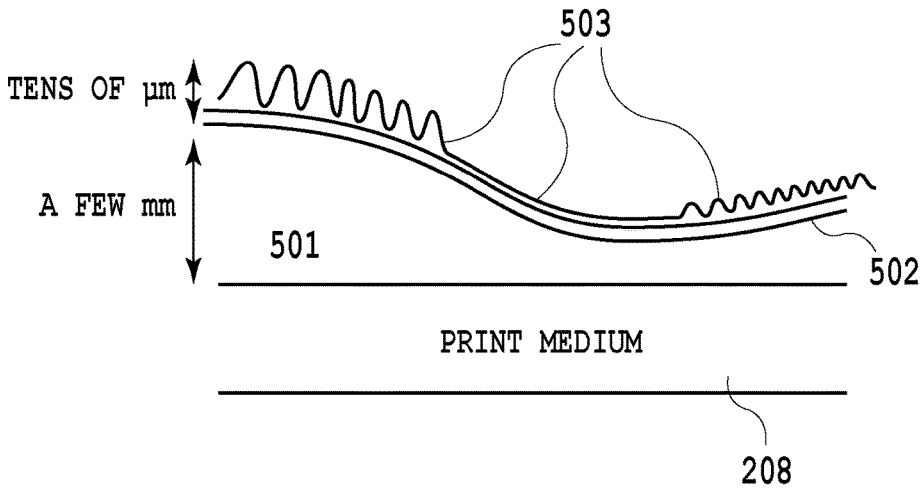
FIG. 5 illustrates the cross sections of a roughness layer, an image layer, and a gloss layer in the embodiment.

FIG. 5 illustrates an example of the cross sections of a roughness layer, an image layer, and a gloss layer generated on the print medium 208. This embodiment will be described based on an assumption that an image layer 502 is formed on a surface of a roughness layer 501 having a distribution of heights of about a few mm and a gloss layer 503 is formed on a surface of the image layer 502. Specifically, the image layer 502 and the gloss layer 503 also have a height distribution but have a thickness of about a few μm at a maximum. Thus, the ultimate influence on the structure is very small and thus may be ignored. The thickness distributions of the image layer 502 and the gloss layer 503 also may be considered by a processing to correct the height data for example. In this embodiment, since the gloss layer 503 is allowed to have a minute shape in order to control the distribution of the specular gloss level, it is assumed that the roughness layer 501 is formed by a shape having a sufficiently low frequency shape by the minute shape of the gloss layer 503.

(Effect by the Minute Shape Control of the Gloss Layer)

In this embodiment, the specular gloss level is controlled by the minute shape at the surface of the gloss layer 503. FIG. 6A to FIG. 6F are schematic views illustrating the gloss layers 503 formed by clear ink having different gloss characteristics. In FIG. 6A to FIG. 6F, the upper diagrams illustrate the ink amounts ejected at the respective coordinate positions while the lower diagrams are schematic views illustrating the cross sections of the gloss layers 503 formed by ejected ink. The following description will be made based on an assumption that a structure formed by the print medium 208, the roughness layer 501, and the image layer 502 has a substantially-smooth base 601. In FIG. 6A to FIG. 6F, the reference numeral 602 denotes a print head and each of the distances D' denotes a schematic distance from the print head 602 to the surface of the base 601 on which the gloss layer 503 is to be formed (hereinafter referred to as "output face").

Figure 6A:
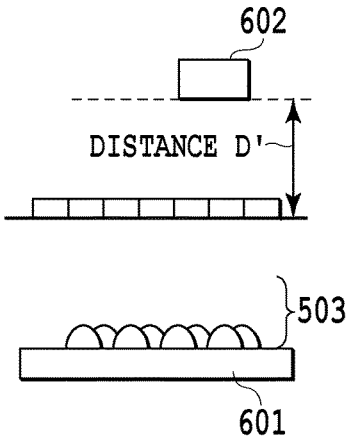
FIG. 6A to FIG. 6F are schematic views illustrating gloss layers having different gloss characteristics in the embodiment.
Figure 6B:
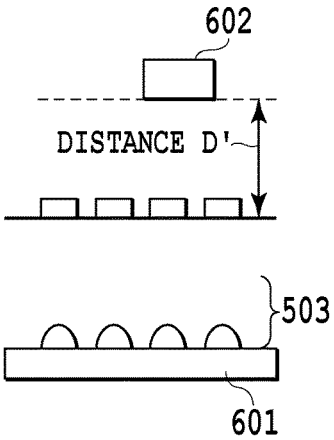

As described with regard to FIG. 3, the printer 200 of this embodiment changes the half tone expression depending on a ratio at which ink dots are ejected to a unit area (i.e., an area ratio). FIG. 6A and FIG. 6B are schematic views illustrating cases where clear ink is ejected with the area ratios of 100% and 25%, respectively.

Almost the entire surface of the base 601 shown in FIG. 6A is covered by clear ink to reduce the difference between the concavities and convexities in the surface of the gloss layer 503. The surface of the base 601 shown in FIG. 6B on the other hand has both of a part covered by clear ink and a part not covered by clear ink, thus causing an increase in the difference between the concavities and convexities in the surface of the gloss layer 503. Thus, normal lines in a minute region of the surface of the gloss layer 503 are arranged in various directions, causing light having entered in a certain direction to be diffused at various angles. By such a structure, the structure in FIG. 6B has a specular gloss level lower than that of the structure in FIG. 6A.

Figure 6C:
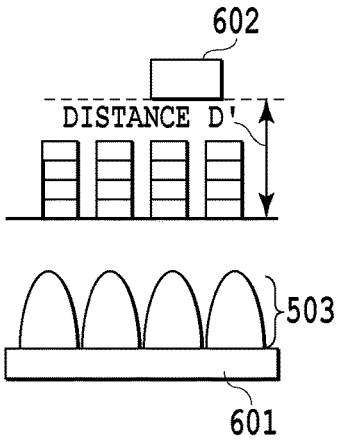

Furthermore, FIG. 6C shows a pattern obtained by forming the gloss layer 503 by using the same area gradation pattern as in FIG. 6B to perform 4 superpositions of clear ink ejected to the same position. The gloss layer 503 of FIG. 6C has a roughness difference higher than that of the gloss layer 503 of FIG. 6B and has an increased normal line angle distribution. Thus, the structure in FIG. 6C has a further-reduced specular gloss level. The relation among the above-described area ratio, the number at which clear ink is superposed, and the specular gloss level is merely an example and changes depending on the compatibility between the characteristic of the print medium 208 and ink for example.

(Printer Operation)

Figure 8:
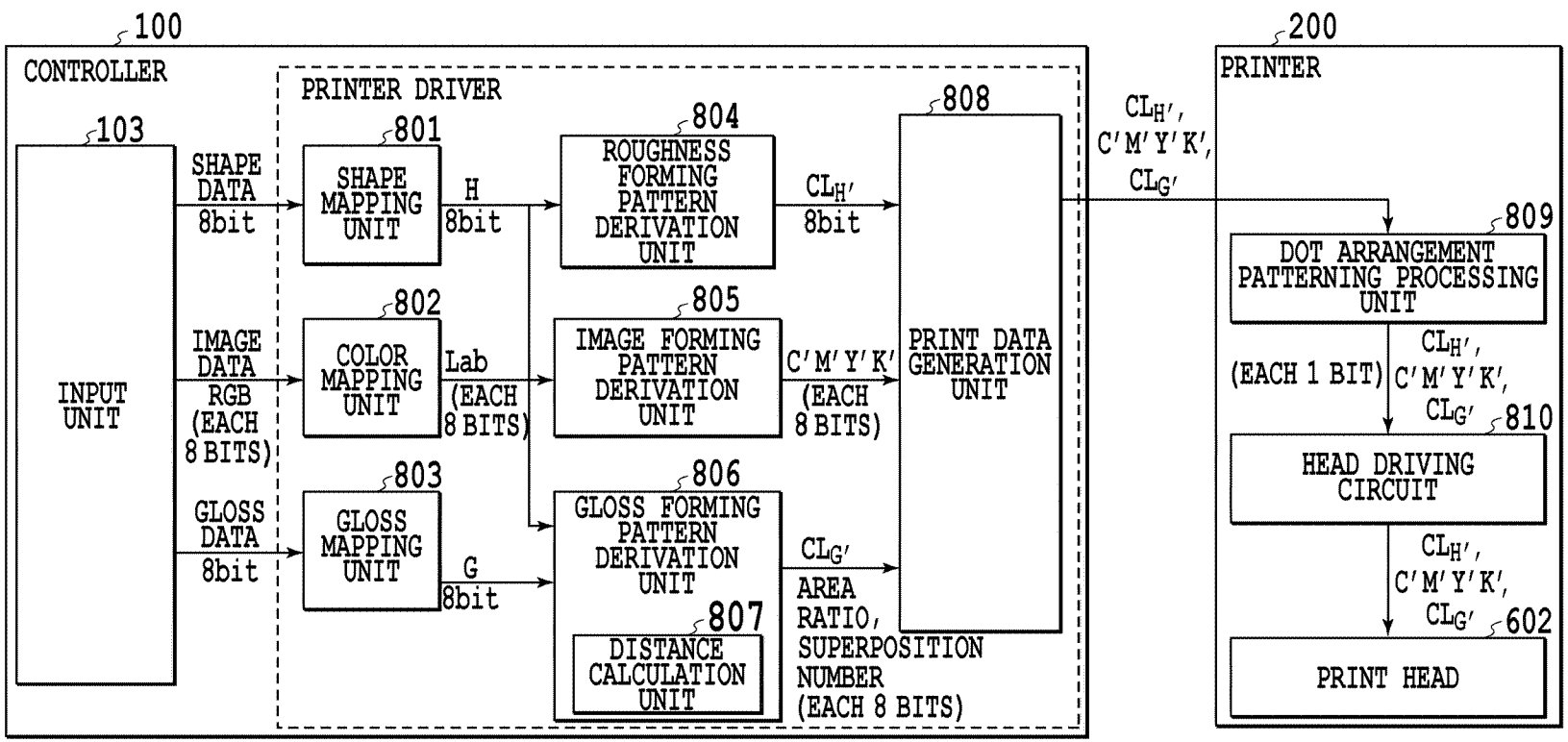
FIG. 8 is a block diagram illustrating the function of a structure formation system in the embodiment.

FIG. 7A to FIG. 7D are flowcharts illustrating a procedure up to a step of allowing the printer 200 of the embodiment to output the structure. The processings according to the flowcharts shown in FIG. 7A to FIG. 7D are carried out by allowing program codes stored in the external storage device 104 to be developed in the memory 102 to allow the CPU 101 to execute the codes. FIG. 8 is a block diagram illustrating the functions of the controller 100 and the printer 200 of embodiment. In this embodiment, the controller 100 corresponds to a gloss control apparatus to control the gloss based on received various data.

In S101, the input unit 103 receives, from an external apparatus for example, an input of shape information, image information, and gloss information. In this embodiment, the shape information, the image information, and the gloss information correspond to shape data, image data, and gloss data that can be controlled by the controller 100.

In this embodiment, the shape data is, for example, point group data outputted from a three-dimensional shape measuring instrument or polygon data used in three-dimensional CAD for example. The point group data is described by a collection of vertexes (x, y, z) in a three-dimensional coordinate space. The polygon data includes vertex coordinates (x, y, z) of a polygonal shape (generally triangle) and is described by a collection of planes determined by a combination of vertexes.

In this embodiment, the image data is, for example, sRGB image data, image data defined by Adobe® RGB, or image data corresponding to a CIELAB color space.

In this embodiment, the gloss data shows a value of a specular gloss level, an image clarity, or a reflection haze for example. The gloss data also may show a value of a distinctness of image.

In S102, the controller 100 converts the shape data, the image data, and the gloss data received in S101 to a shape signal, an image signal, and a gloss signal corresponding to the roughness layer 501, the image layer 502, and the gloss layer 503 that can be reproduced by the printer 200, respectively. The conversion processing in S102 will be hereinafter referred to as a mapping processing. The details of the mapping processing will be described later.

In S103, the controller 100 converts the shape signal, the image signal, and the gloss signal converted in S102 to a control signal for controlling the printer 200. As described above, the printer 200 of this embodiment is an inkjet-type structure forming apparatus. The control signal converted in S103 is a signal representing the amount of ink to be ejected from the structure forming apparatus to the print medium 208 for example. The details of S103 will be described later.

In S104, the printer 200 outputs the structure onto the print medium 208 based on the control signal converted in S103.

(Mapping)

FIG. 7B is a flowchart illustrating a procedure of the mapping processing in this embodiment. FIG. 7B corresponds to the sub routine of S102 in FIG. 7A.

In S201, a shape mapping unit 801 converts the shape data received in S101 to a shape signal corresponding to the roughness shape that can be reproduced by the printer 200. The shape signal of this embodiment is a height signal H (x, y) representing the height of each coordinate in the xy coordinate system on the basis of a pixel unit defined based on the output resolution of the printer 200. The conversion processing in S201 will be hereinafter referred to as a shape mapping processing.

The shape mapping unit 801 corrects the converted shape signal so that the corrected signal functions as a shape signal corresponding to a roughness shape that can be reproduced by the printer 200. For example, the roughness layer 501 is formed by ejecting clear inks superposed a plurality of times. Thus, the printer 200 cannot output a roughness shape floating in air. In this case, the shape mapping unit 801 retains the maximum height Hmax (x, y) of the roughness layer 501 in the memory 102 and corrects a blank existing from the surface height of the print medium 208 to the maximum height Hmax (x, y) by complementing the blank with dummy data for example.

In a case where the height signal H (x, y) exceeds the range that can be outputted from the printer 200, the shape mapping unit 801 performs a clipping processing to correct the height signal H (x, y) so that the height signal H (x, y) is equal to or lower than H_TH. H_TH shows a height that can be outputted by the printer 200. The embodiment to correct the height signal H (x, y) is not limited to the above one. For example, another method also may be used to subject the height signal H (x, y) to linear compression.

In S202, a color mapping unit 802 converts the image data received in S101 to an image signal corresponding to colors that can be reproduced by the printer 200. The image signal in this embodiment uses an image signal Lab (x, y) representing the colors of the respective coordinates in the xy coordinate system of a pixel unit defined based on the output resolution of the printer 200. The conversion processing in S202 will be hereinafter referred to as a color mapping processing.

First, the color mapping unit 802 converts the image data received in S101 to the image signal Lab (x, y). In a case where the image data received in S101 is composed of the value of the image signal RGB, the color mapping unit 802 can convert the image signal RGB to the image signal Lab based on a known method such as sRGB.

Next, the color mapping unit 802 determines whether or not the converted image signal Lab (x, y) corresponds to the colors that can be reproduced by the printer 200. In this embodiment, the color mapping unit 802 retains CIELAB representing a reproducible color gamut for example in the memory 102 as color gamut information and compares the image signal Lab (x, y) and the color gamut information to thereby perform the above determination. In a case where the image signal Lab (x, y) cannot be reproduced by the printer 200, the color mapping unit 802 corrects the image signal Lab (x, y) to an image signal corresponding to the colors that can be reproduced by the printer 200. The color mapping unit 802 corrects, with regard to the CIELAB, the image signal Lab (x, y) so that the hue angles are the same and the color difference $\Delta E$ is minimum.

In S203, the gloss mapping unit 803 converts the gloss data received in S101 to a gloss signal corresponding to a gloss level that can be reproduced by the printer 200. The gloss signal of this embodiment is a gloss signal G (x, y) representing the gloss level of each coordinate in the xy coordinate system of a pixel unit defined based on the output resolution of the printer 200. In this embodiment, an embodiment will be described that uses the gloss signal corresponding to the specular gloss level. The conversion processing in S203 will be hereinafter referred to as a gloss mapping processing.

First, a gloss mapping unit 803 converts the gloss data received in S101 to a gloss signal G (x, y). The gloss mapping unit 803 can convert the gloss data to the gloss signal G (x, y) by referring to a lookup table (hereinafter referred to as "LUT") for example.

Next, the gloss mapping unit 803 determines whether or not the converted gloss signal G (x, y) corresponds to the gloss level that can be reproduced by the printer 200. For example, the gloss mapping unit 803 retains, in the memory 102, a gloss level range that can be outputted by the printer 200 to compare the gloss signal G (x, y) with the gloss level range to thereby make the above determination.

In a case where the gloss signal G (x, y) cannot be reproduced by the printer 200, the gloss mapping unit 803 corrects the gloss signal G (x, y) to a gloss signal corresponding to a gloss level that can be reproduced by the printer 200. The embodiment to correct the gloss signal G (x, y) is not limited to the above one. For example, a method to subject the gloss signal G (x, y) to linear compression or a clipping processing also may be used.

As described above, the shape mapping processing, the color mapping processing, and the gloss mapping processing are used to output the shape signal H (x, y), the image signal CMYK (x, y), and the gloss signal G (x, y), respectively. The order of the mapping processings from S201 to S203 is merely an example and the order of the mapping processings from S201 to S203 may be changed.

(Conversion to Control Signal)

FIG. 7C is a flowchart illustrating a procedure of a conversion processing to obtain a control signal to control the printer 200 in this embodiment. This flowchart corresponds to the sub routine of S103 in FIG. 7A.

In S301, a roughness forming pattern derivation unit 804 derives a roughness forming pattern CLH' (x, y) from the height signal H (x, y) outputted in S201.

First, the roughness forming pattern derivation unit 804 refers to the LUT shown in FIG. 9A and converts the height signal H (x, y) to the clear ink amount CLH (x, y) for each coordinate. FIG. 9A illustrates an example of the LUT in which the height signal H (x, y) corresponds to the clear ink amount CLH (x, y). The correspondence to the LUT values is set so that, in a case where the inputted height signal H is "16" for example, the clear ink amount CLH to be outputted is "100%". In a case where the height signal H having a value of "24" not shown in the LUT of FIG. 9A is inputted, the roughness forming pattern derivation unit 804 uses a method such as a known linear interpolation to convert the height signal H to the clear ink amount CLH such as "150%".

Generally, the height of the roughness layer 501 and the clear ink amount CLH have a proportional relation therebetween. There may be a case where the wetting spreading characteristic of clear ink causes a roughness shape having a high frequency to undesirably have a reduced sharpness. To prevent this, the clear ink amount CLH may be appropriately subjected to MTF (Modulation Transfer Function).

The gloss layer 503 is configured so that the gloss level is controlled by forming a minute roughness shape in the surface. Thus, in a case where the roughness layer 501 includes a high-frequency shape, the gloss level expressed by the gloss layer 503 is undesirably influenced. In order to avoid the influence on the gloss level expressed by the gloss layer 503, the roughness forming pattern derivation unit 804 desirably applies a low-pass filter for cutting off a high-frequency component to the clear ink amount CLH.

Next, the roughness forming pattern derivation unit 804 derives, based on the clear ink amount $CL_H$ (x, y), the roughness forming pattern $CL_H'$ (x, y) representing the clear ink ejection number for each coordinate. In this embodiment, in a case where the clear ink amount $CL_H$ shows "100%", clear ink is ejected one time from the print head. Thus, in a case where the clear ink amount $CL_H$ includes a fraction less than 100% such as "75%", "125%", or "250%", then the roughness forming pattern derivation unit 804 uses a binarization processing to stochastically determine whether or not clear ink is ejected. Generally, this binarization processing is called a half tone processing and can use a known dither method or error diffusion method. For example, in a case where the dither method is used, quantization can be performed by comparing a mask image called a threshold value matrix with an input value.

In S302, an image forming pattern derivation unit 805 derives the image forming pattern C'M'Y'K' (x, y) from the image signal Lab (x, y) outputted in S202.

First, the image forming pattern derivation unit 805 refers to the LUT shown in FIG. 9B to convert the image signal Lab (x, y) to the color ink amount CMYK (x, y) for each coordinate. FIG. 9B illustrates an example of the LUT in which the image signal Lab (x, y) corresponds to the color ink amount CMYK (x, y). Such an LUT can be a known LUT used for a general color printer.

Next, the image forming pattern derivation unit 805 derives, based on the color ink amount CMYK (x, y), the image forming pattern C'M'Y'K' (x, y) representing the color ink ejection number for each coordinate. As in S301, the image forming pattern derivation unit 805 can use the quantization processing using a threshold value matrix to convert the color ink amount CMYK (x, y) to the image forming pattern C'M'Y'K' (x, y).

In S303, a distance calculation unit 807 calculates the distance D' from the print head to the output face on which the gloss layer 503 is to be formed for each coordinate of the xy coordinate system of the pixel unit defined based on the output resolution of the printer 200. The distance calculation unit 807 retains an appropriate distance D having a high ink dot landing position accuracy in a storage region such as the memory 102 in advance. The distance calculation unit 807 can call the appropriate distance D from the storage region to calculate the difference between the appropriate distance D and the height signal H (x, y) to thereby calculate the distance D' from the print head to the output face.

In S304, a gloss forming pattern derivation unit 806 calculates the gloss forming pattern $CL_G'$ (x, y) based on the gloss signal G (x, y) outputted in S203 and the distance D' (x, y) outputted in S303. FIG. 9C is a schematic view illustrating an example of the LUT in which the correspondence is established among the distance D', the gloss signal G, and the gloss forming pattern $CL_G'$. In this embodiment, the gloss forming pattern $CL_G'$ is configured by a combination of the area ratio A and the superposition number n. The gloss forming pattern derivation unit 806 determines, depending on the area ratio A obtained by referring to the LUT of FIG. 9C, a coordinate to which clear ink for forming the gloss layer 503 is ejected. Furthermore, the gloss forming pattern derivation unit 806 determines, with regard to the determined coordinate, the superposition number n representing the number at which clear ink is ejected. For example, in a case where the area ratio A=25% and the superposition number n=5 are established, then the gloss forming pattern $CL_G'$ corresponding to the dot pattern illustrated at the lower-right side of FIG. 3 is derived. Then, clear ink is ejected five times to the coordinates shown by the black rectangles in the dot pattern in the lower-right side of FIG. 3.

Next, a print data generation unit 808 generates such print data that is obtained by adding print control information to print image data including the roughness forming pattern $CL_H'$ (x, y), the image forming pattern C'M'Y'K' (x, y), and the gloss forming pattern $CL_G'$ (x, y). The print control information includes information regarding a paper type for printing such as a regular paper, a glossy paper, or a coated paper and information regarding the definition such as a high-speed print and a high-definition print. Such print control information can be received from a user via the input unit 103.

As described above, in S304, the gloss forming pattern derivation unit 806 derives the gloss forming pattern $CL_G'$ (x, y) in consideration of the shape information. Thus, depending on the distance D' from the print head to the output face, the printer 200 can eject clear ink based on a different area ratio A and a different superposition number.

(Change of the Gloss Layer Depending on the Distance from the Print Head to the Output Face)

Figure 10:
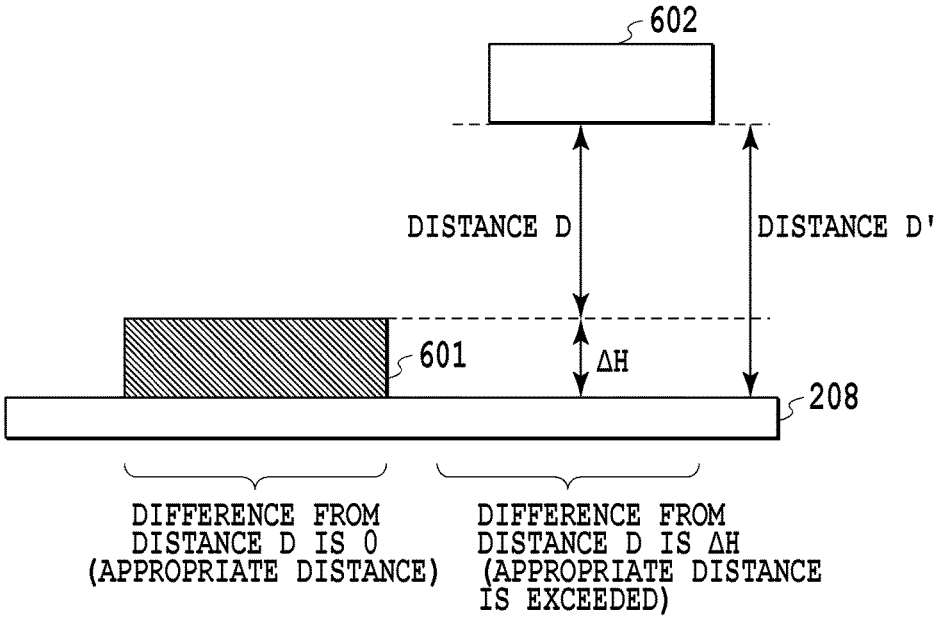
FIG. 10 is a schematic view illustrating the positional relation between a print head and an output face in the embodiment.

FIG. 10 is a schematic view illustrating the positional relation between the print head and the output face. The following section will describe, with reference to FIG. 10, an effect given by the gloss layer 503 formed depending on the distance from the print head to the output face.

Generally, the print head ejects ink while maintaining a fixed distance between the print head and a print medium. However, the print head of this embodiment ejects ink onto a surface of a base having a height of a few mm formed on the print medium (the print medium 208, the roughness layer 501, the image layer 502). Thus, the printer 200 of this embodiment cannot maintain a fixed distance between the print head and the output face. In order to maintain a fixed distance between the print head and the output face, a method may be considered according to which the print head performs scanning in accordance with the height of the base. However, this method requires the printer 200 having a more complicated mechanism and thus is suppressed from being realized because of the accuracy and cost for example.

Generally, an increase of the distance between the print head and the output face causes a decrease in the landing accuracy at which ink dots land at desired positions. A decreased landing accuracy also causes a phenomenon called mist for example in which ink dots are stirred up by air current and fail to land at the output face.

In FIG. 10, the distance D from the print head 602 to the output face (base 601) corresponds to an appropriate distance and ink dots ejected from the print head 602 have a high landing accuracy. On the other hand, the distance D' from the print head 602 to an output face having thereon no roughness layer 501 (i.e., the print medium 208) is a not-appropriate distance away from the appropriate distance D by a difference ΔH. Thus, the resultant ink dots have a low landing accuracy. Thus, a case is also caused in which the above-described mist phenomenon for example prevents a high-definition image from being outputted.

Figure 6D:
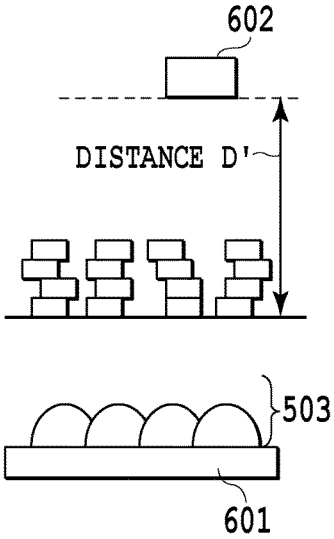

FIG. 6D illustrates a gloss forming pattern for which the same area gradation pattern as that of FIG. 6C is used and clear ink is ejected four times from a distance other than the appropriate distance to form the gloss layer 503. The clear ink landing accuracy in FIG. 6D is lower than that of FIG. 6C. Thus, an error is caused in the landing position even by ink dots ejected aiming at the same coordinate. The landing position error causes the gloss layer 503 in FIG. 6D to have a surface shape undesirably increased when compared with the surface shape of the gloss layer 503 in FIG. 6C. Since the gloss layer 503 in FIG. 6D has a reduced surface roughness difference, the normal line angle distribution is also reduced, which consequently makes it difficult to suppress the specular gloss level of the structure.

Figure 11:
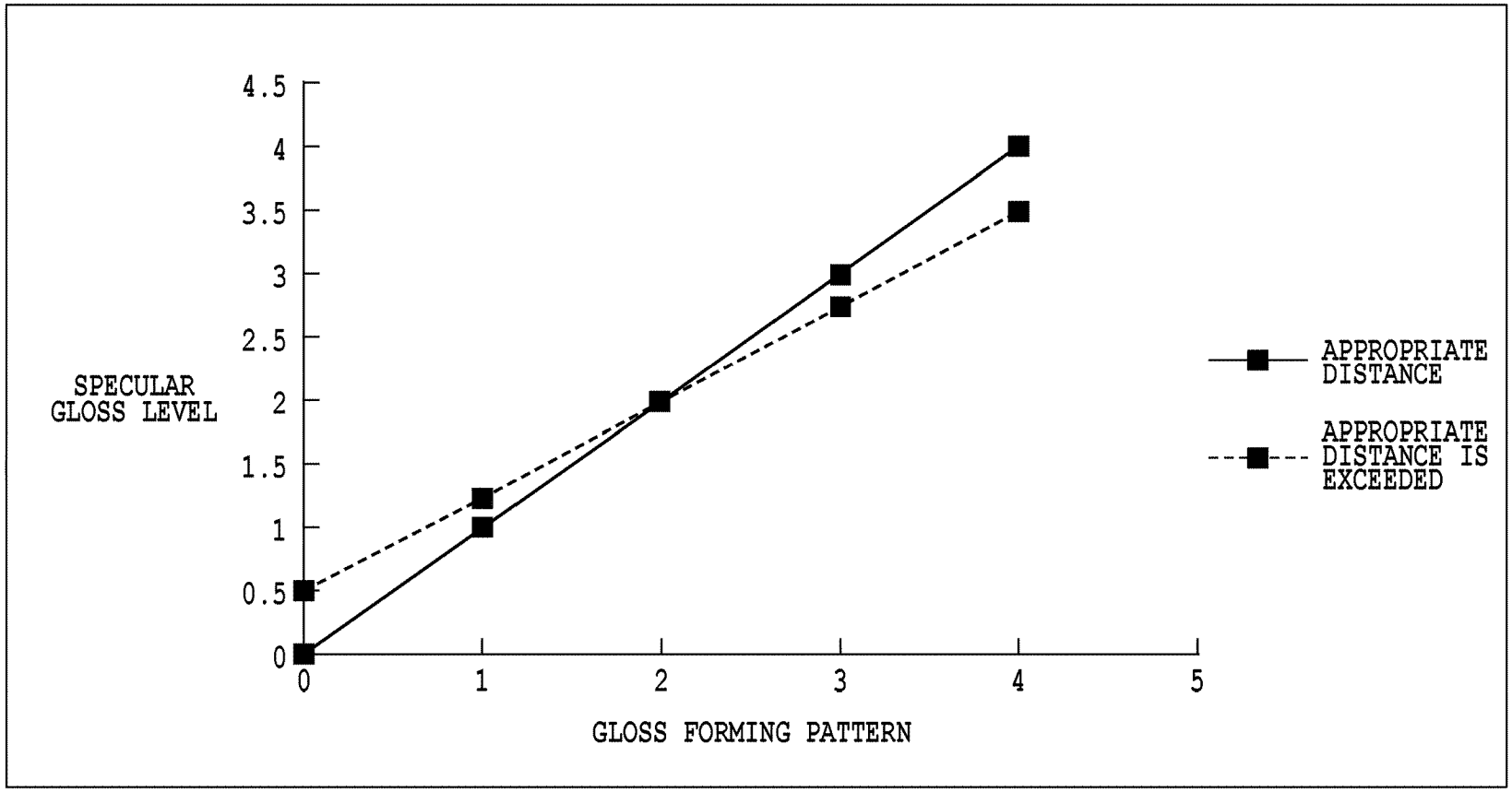
FIG. 11 illustrates the relation between a gloss forming pattern and a specular gloss level in the embodiment.

FIG. 11 is a graph illustrating the relation between the gloss forming pattern and the specular gloss level. In the graph of FIG. 11, the gloss forming pattern 1 is set so that "area ratio A=25%, superposition number n=4" for example. In a case where ink is ejected from an appropriate distance, the gloss layer 503 as shown in FIG. 6C is formed. In a case where ink is ejected from a distance other than the appropriate distance on the other hand, the gloss layer 503 as shown in FIG. 6D is formed. As described above, the gloss layer 503 in FIG. 6D has a surface shape undesirably increased compared with the surface shape of FIG. 6C. As a result, as shown in the graph of FIG. 11, the structure formed by the appropriate distance has a specular gloss level representing a more-suppressed value.

On the other hand, in a case where the same area gradation pattern as that of FIG. 6A is used to eject ink from a distance other than the appropriate distance to form the gloss layer 503, the landing position includes an error, thus causing a region in which ink dots are superposed and a region in which ink dots are dispersed. The error in the landing position causes the minute roughness plane formed on the surface of the base 601 to have an increased roughness difference, which undesirably causes the resultant structure to have a lower specular gloss level.

In the graph of FIG. 11, the gloss forming pattern 4 is set so that "area ratio A=100%, superposition number n=1" is established for example. In a case where ink is ejected from the appropriate distance, then the gloss layer 503 as shown in FIG. 6A is formed. In a case where ink is ejected from a distance other than the appropriate distance on the other hand, the landing position includes an error, thus causing a region in which ink dots are superposed and a region in which ink dots are dispersed. As a result, as shown in the graph of FIG. 11, the resultant structure formed based on the distance other than the appropriate distance has a specular gloss level having a value lower than a desired value.

Methods to compensate for the increase of the surface shape due to the error in the ink dot landing position may conceivably include a method of increasing the number of superposed ink dots. However, merely increasing the number of superposed ink dots may fail to provide a sufficient effect.

Figure 6E:
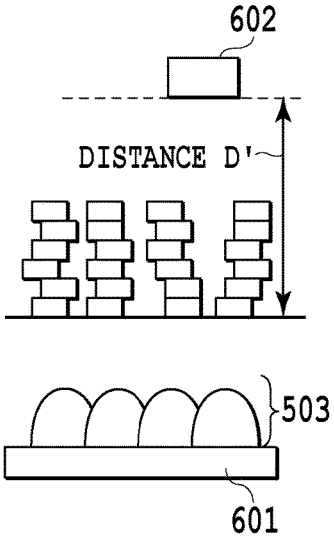

FIG. 6E illustrates a pattern obtained by ejecting clear ink for the total of six times including additional two times using the same area gradation pattern as that of FIG. 6D to form the gloss layer 503. In this embodiment, a collection of clear ink ejected aiming at the same coordinate will be referred to as a cluster. As shown in FIG. 6E, even clear ink superposed in an increased number similarly causes an error in the landing positions of the respective clear inks. This causes adjacent clusters to cling to one another, which makes it difficult to control a minute roughness difference and to control a normal line angle distribution.

In view of the above, this embodiment controls the number at which clear ink is superposed and an interval between clusters. With regard to the printer 200 having a specific distance from the print head to the output face, such a combination that can realize a desired gloss level can be experimentally calculated in advance between the number at which clear ink is superposed and an interval between clusters.

Figure 6F:
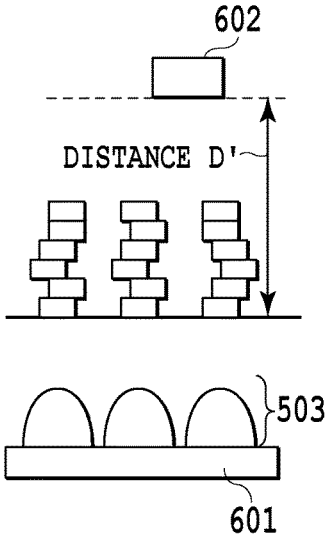

FIG. 6F shows a case where clusters are formed by ink similarly ejected as in FIG. 6D and FIG. 6E from a distance other than the appropriate distance but the clusters have thereamong increased intervals. Thus, clear ink can be superposed in a number increased from 4 to 6 to thereby provide a minute roughness plane having a sufficient roughness or a sufficient normal line angle distribution. In a printer control signal processing such as a half tone processing, the use of a highly-dispersed threshold value matrix allows a lower area ratio to have a wider cluster interval and allows a higher area ratio to have a narrower cluster interval.

In this embodiment, the above method is used to allow the controller 100 to determine the area ratio A based on the distance from the print head to the output face and the specular gloss level, thereby controlling the cluster interval. The embodiment is not limited to this. Another method also may be used according to which the area ratio A having a fixed value is used to allow the memory 12 to retain a threshold value matrix corresponding to the distance from the print head to the output face and the specular gloss level so that the cluster interval can be controlled for example. In this embodiment, the gloss forming pattern derivation unit 806 refers to the LUT of FIG. 9C based on the distance from the print head to the output face and the gloss signal G to derive the gloss forming pattern $CL_G'$ (S304), thereby controlling the gloss level expressed by the structure.

(Structure Output)

FIG. 7D is a flowchart illustrating a procedure in which the printer 200 outputs a structure in this embodiment. The flowchart corresponds to the sub routine of S104 in FIG. 7A.

In S401, the printer 200 ejects clear ink based on the roughness forming pattern $CL_H'$ (x, y) derived in S103 and forms the roughness layer 501 on the print medium 208. More specifically, the control unit 220 of the printer 200 controls a functional block from a dot arrangement patterning processing unit 809 to the print head 602 to thereby perform an operation to form the roughness layer 501.

With regard to each pixel corresponding to a roughness shape to be formed, the dot arrangement patterning processing unit 809 arranges dots based on a dot arrangement pattern corresponding to index data representing print image data (gradation value information). As described above, the printing by the inkjet printer is performed based on binary information whether or not ink is ejected. The dot arrangement patterning processing unit 809 allocates a dot arrangement pattern corresponding to the gradation value of the pixel to each pixel represented by the roughness forming pattern $CL_H'$ (x, y). As a result, whether dots are turned ON or OFF is defined for each of a plurality of regions within one pixel. Thus, binary ejection data showing "1" or "0" is placed within each region in the one pixel. The binary ejection data is transmitted to a head driving circuit 810 at an appropriate timing to drive the print head 602, thereby ejecting clear ink based on the binary ejection data.

In order to assist the coloring of the image layer 502 formed in S402, a white ink layer having a uniform thickness may be formed over the entire surface of the roughness layer 501. This may be achieved by performing a control to eject white ink so that the area ratio=100% is established for the entire surface of the print medium 208 for example.

In S402, the printer 200 ejects color inks based on the image forming pattern C'M'Y'K' (x, y) derived in S103 to form the image layer 502 on the gloss layer 503. The operation to form the image layer 502 is performed, as in S401, by allowing the control unit 220 of the printer 200 to control the functional block from the dot arrangement patterning processing unit 809 to the print head 602.

In S403, the printer 200 ejects clear ink based on the gloss forming pattern $CL_G'$ (x, y) derived in S104 and forms the gloss layer 503 on the image layer 502. The operation to form the gloss layer 503 is performed, as in S401, by allowing the control unit 220 of the printer 200 to control the functional block from the dot arrangement patterning processing unit 809 to the print head 602.

As described above, the gloss control apparatus of this embodiment derives the gloss forming pattern $CL_G'$ based on the gloss signal G and the distance from the print head to the output face. The printer 200 forms the gloss layer 503 depending on the derived gloss forming pattern $CL_G'$. The configuration as described above allows the gloss control apparatus of this embodiment to control a desired gloss level to form gloss on a surface of a roughness shape, even in a case where a change is caused in the distance from the print head to the output face.

Other Illustrative Embodiments

In the above-described embodiment, the gloss forming pattern $CL_G'$ is derived based on the distance from the print head to the output face. The information regarding the distance from the print head to the output face has, in the above-described embodiment, a very strong correlation with the landing accuracy of ink ejected from the print head. The embodiment also may use other parameters considering a landing error due to a change in the print environment including a driving characteristic such as a change in a print head speed, an irregular influence by air current due to a position of the print head, an individual difference of the printer 200, or the temperature of the printer 200 for example.

In the embodiment, the gloss forming pattern $CL_G'$ was derived based on the distance from the print head to the output face. However, the gloss forming pattern $CL_G'$ also may be derived depending on the shape, the frequency characteristic or the amplitude characteristic of the base 601 on which the gloss layer 503 is to be formed, or the inclination angle of the output face.

In the above-described embodiment, an example of an inkjet printing apparatus was described in which ultraviolet-curable clear ink was used to form the roughness layer 501. However, the embodiment is not limited to this. Furthermore, in the above-described embodiment, an embodiment was described in which a structure was formed by superposing the roughness layer 501, the image layer 502, and the gloss layer 503. However, another embodiment also may be carried out in which the image layer 502 and the gloss layer 503 are formed on an output face for which a roughness shape is already formed on the print medium 208. In this case, the calculation of the distance from the print head to the output face (S303) requires shape data such as point group data. However, roughness layer formation-related processings such as the derivation of a roughness forming pattern (S304) or the roughness formation (S401) can be omitted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment (s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment (s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The gloss control apparatus of the present invention can control, even with a change in the distance from the print head to the output face, a desired gloss level in a case where a gloss layer is formed on a surface of a roughness shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-010010, filed Jan. 21, 2016, which is hereby incorporated by reference herein in its entirety.

What is claimed is:

1. A control apparatus for generating print data indicating a pattern for forming a gloss layer and supplying the print data to a forming apparatus for forming the gloss layer that provides gloss to a rough surface, the control apparatus comprising:

an obtaining unit configured to obtain distance information indicating a distance from a printing unit of the forming apparatus to an output face on which the gloss layer is to be formed;

a derivation unit configured to derive the pattern which is part of the print data based on the distance information and gloss information representing the gloss level of the gloss; and a generation unit configured to generate the print data based on the pattern derived by the derivation unit and output the generated print data to the forming apparatus, wherein the derivation unit determines an area ratio at which print material dots are to be ejected per unit area by the forming apparatus and a superposition number of the print material dots based on the distance information and the gloss information and determines coordinates at which the print material is to be ejected according to the area ratio so as to derive gloss pattern data indicating whether or not the print material is to be ejected to each pixel as the pattern.

2. The control apparatus according to claim 1, wherein the derivation unit further determines a superposition number representing a number of print material dots to be ejected by the forming apparatus aiming at the same position.

3. The control apparatus according to claim 2, wherein the obtaining unit obtains the distance information by obtaining height information representing a height of the roughness shape and calculating, based on the height information, the distance from the printing unit of the forming apparatus to the output face to which the gloss layer is to be outputted.

4. The control apparatus according to claim 3, wherein the derivation unit determines the area ratio at which print material dots are to be ejected per unit area by the forming apparatus and determines the area ratio corresponding to the gloss information so that the longer the distance, the lower the area ratio.

5. The control apparatus according to claim 4, wherein the derivation unit determines the superposition number corresponding to the gloss information so that the longer the distance, the higher the superposition number.

6. The control apparatus according to claim 1, wherein the pattern comprises a control signal for controlling an amount of print material to be ejected by the forming apparatus, and the pattern is configured by a combination of the area ratio at which print material dots are to be ejected per unit area by the forming apparatus and the superposition number representing a number of print material dots to be ejected aiming at the same position.

7. The control apparatus according to claim 1, further comprising:

a roughness forming pattern derivation unit configured to derive, from the distance information, a roughness forming pattern to form the roughness shape, wherein the roughness forming pattern refers to data indicating whether or not the print material is to be ejected to each pixel, and the generation unit outputs the roughness forming pattern as part of the print data.

8. The control apparatus according to claim 1, further comprising:

an image forming pattern derivation unit configured to derive, from image information, an image forming pattern for forming an image on the surface of the roughness shape, wherein the image forming pattern refers to data indicating whether or not the print material is to be ejected to each pixel, and the generation unit outputs the image forming pattern as part of the print data.

9. The control apparatus according to claim 1, wherein the gloss information is at least one of values representing a specular gloss level, an image clarity, a distinctness of image, and a reflection haze.

10. The control apparatus according to claim 1, wherein the distance information is at least one of a frequency characteristic and an amplitude characteristic of the roughness shape.

11. A forming apparatus for forming a gloss layer providing gloss to a surface of a roughness shape, comprising:

an obtaining unit configured to obtain a pattern to form a gloss layer providing gloss to a surface of the roughness shape as print data; and a forming unit configured to form, based on the pattern, the gloss layer on the surface of the roughness shape, wherein the forming unit forms the gloss layer by forming print material dots at a superposition number of print material dots according to gloss information representing a gloss level, and wherein a superposition number of print material dots corresponding to a lowest gloss level in a case where a distance from the forming unit in the forming apparatus to a height of the roughness shape is long is set to be greater than a superposition number corresponding to the lowest gloss level in a case where the distance is short.

12. The forming apparatus according to claim 11, further comprising:

a roughness forming unit configured to form, according to a roughness forming pattern to form the roughness shape, the roughness shape on a print medium, wherein the forming unit forms the gloss layer on the surface of the roughness shape formed on the print medium.

13. A control method for a control apparatus for generating print data indicating a pattern for forming a gloss layer and supplying the print data to a forming apparatus for forming the gloss layer that provides gloss to a rough surface, the control method comprising the steps of:

obtaining distance information indicating a distance from a printing unit of the forming apparatus to an output face on which the gloss layer is to be formed;

deriving the pattern which is part of the print data based on the distance information and gloss information representing the gloss level of the gloss; and generating the print data based on the pattern derived in the deriving step and outputting the generated print data to the forming apparatus, wherein the deriving step determines an area ratio at which print material dots are to be ejected per unit area by the forming apparatus and a superposition number of the print material dots based on the distance information and the gloss information and determines coordinates at which the print material is to be ejected according to the area ratio so as to derive gloss pattern data indicating whether or not the print material is to be ejected to each pixel as the pattern.

14. A non-transitory computer readable storage medium storing a program for causing a computer to function as a control apparatus for generating print data indicating a pattern for forming a gloss layer and supplying the print data to a forming apparatus for forming the gloss layer that provides gloss to a rough surface, where the control apparatus comprises:

an obtaining unit configured to obtain distance information indicating a distance from a printing unit of the forming apparatus to an output face on which the gloss layer is to be formed;

a derivation unit configured to derive the pattern which is part of the print data based on the distance information and gloss information representing the gloss level of the gloss; and a generation unit configured to generate the print data based on the pattern derived by the derivation unit and output the generated print data to the forming apparatus, wherein the derivation unit determines an area ratio at which print material dots are to be ejected per unit area by the forming apparatus and a superposition number of the print material dots based on the distance information and the gloss information and determines coordinates at which the print material is to be ejected according to the area ratio so as to derive gloss pattern data indicating whether or not the print material is to be ejected to each pixel as the pattern.

15. The control apparatus according to claim 1, wherein the derivation unit determines a superposition number such that the superposition number for a gloss level in a case where the distance is long is set to be greater than the superposition number for the gloss level in a case where the distance is short.

16. The control apparatus according to claim 1, wherein the derivation unit derives the pattern so that the area ratio at which print material dots are ejected per unit area by the forming apparatus for same gloss information in a case where the distance is long is made less than the area ratio for same gloss information in a case where the distance is short, and a superposition number representing a number of print material dots to be ejected by the forming apparatus aiming at the same position in a case where the distance is long is set to be greater than the superposition number in a case where the distance is short.

17. The control apparatus according to claim 1, wherein the derivation unit derives a different pattern according to the distance information from gloss information representing the same gloss level of the gloss.

* * * * *